US008595884B2

(12) United States Patent
Tawara

(10) Patent No.: US 8,595,884 B2
(45) Date of Patent: Dec. 3, 2013

(54) CLEANING TOOL AND STICK-LIKE TOOL

(75) Inventor: Hirotoshi Tawara, Tokyo (JP)

(73) Assignee: Kao Corporation, Tokyo (JP)

( * ) Notice: Subject to any disclaimer, the term of this patent is extended or adjusted under 35 U.S.C. 154(b) by 759 days.

(21) Appl. No.: 12/671,451

(22) PCT Filed: Jul. 30, 2008

(86) PCT No.: PCT/JP2008/063699

§ 371 (c)(1),
(2), (4) Date: Jan. 29, 2010

(87) PCT Pub. No.: WO2009/017171

PCT Pub. Date: Feb. 5, 2009

(65) Prior Publication Data

US 2010/0186181 A1 Jul. 29, 2010

(30) Foreign Application Priority Data

Aug. 1, 2007 (JP) ..... 2007-201203

(51) Int. Cl.
*A47L 13/42* (2006.01)

(52) U.S. Cl.
USPC ..... 15/144.1; 15/144.4

(58) Field of Classification Search
USPC ..... 15/144.1, 144.4
See application file for complete search history.

(56) References Cited

U.S. PATENT DOCUMENTS

| | | | | |
|---|---|---|---|---|
| 7,743,458 | B1 * | 6/2010 | Moore et al. | 15/257.2 |
| 7,886,396 | B2 * | 2/2011 | Gracindo et al. | 15/144.4 |
| 2005/0102781 | A1 | 5/2005 | Tsuchiya et al. | |
| 2006/0191089 | A1 | 8/2006 | Gracindo et al. | |

FOREIGN PATENT DOCUMENTS

| | | | |
|---|---|---|---|
| EP | 1 523 919 | A1 | 4/2005 |
| JP | 63-14841 | U | 1/1988 |
| JP | 2003-107998 | A | 4/2003 |
| JP | 2004-49618 | A | 2/2004 |
| JP | 2004-49619 | A | 2/2004 |
| WO | 2004/008935 | A1 | 1/2004 |

* cited by examiner

*Primary Examiner* — Randall Chin
(74) *Attorney, Agent, or Firm* — Birch, Stewart, Kolasch & Birch, LLP

(57) ABSTRACT

In a cleaning tool 1, a lock piece 50 provided to the other of a handle 10 and a main body 20 can be switched between a lock position and a lock release position, the lock piece 50 positioned in the lock position butts against a stopper face 41D of an engagement member 41 to retain the engagement member 41 in a position of engagement with the recessed face 36, and the lock piece 50 positioned in the lock release position separates from the stopper face 41D of the engagement member 41 to allow the engagement member 41 to resiliently move forward and backward.

5 Claims, 19 Drawing Sheets

CLEANING TOOL AND STICK-LIKE TOOL

This application is a 371 of PCT/JP2008/063699 filed Jul. 30, 2008.

TECHNICAL FIELD

The present invention relates to a cleaning tool and a stick-like tool suitable for a handle or the like of the cleaning tool.

BACKGROUND ART

As a cleaning tool having a main body that can be set at multiple angles with respect to a handle, there is one disclosed in Patent Document 1, in which the handle and the main body are pivoted on a pivot portion, recessed portions are formed at a plurality of positions of the main body in a rotating direction about the pivot portion, a lock member mounted in the handle is biased toward the recessed portions, and the lock member is fitted in any of the recessed portions to lock an angle between the handle and the main body.

Moreover, the cleaning tool is to be used in a manner that by pushing in a button protruding from a side face of the handle, the lock member engaged with the button is displaced from a position where it has been fitted in the recessed portion to allow the main body to rotate freely with respect to the handle and the main body can be set at a new angle with respect to the handle.

As a stick-like tool used for a handle or the like of a cleaning tool, there is a wand described in Patent Document 2, in which an inner shaft is inserted into a hollow portion of an outer shaft and they are connected to be extendable in an axial direction. This wand is formed by fixing a base end portion of a leaf spring to an outer face of the outer shaft so that the leaf spring is placed along the outer face, fixing a long lock rail in an axial direction of an outer face of the inner shaft, and forming a large number of lock holes at regular intervals in a longitudinal direction of the lock rail. An operating portion for lifting the leaf spring from the outer face of the outer shaft is provided to a tip end portion of the leaf spring, a lock piece is formed by notching and bending a middle portion of the leaf spring, and engaging the lock piece in any of the lock holes formed in the lock rail on the outer face of the inner shaft through a window portion formed in the outer shaft utilizing a resilient property of the leaf spring so that the outer shaft and the inner shaft can be fixed at an arbitrary extension length. If the leaf spring is lifted from the outer face of the outer shaft by using the operating portion of the leaf spring, the lock piece of the leaf spring is withdrawn from the lock hole of the lock rail on the outer face of the inner shaft to allow the outer shaft and the inner shaft to extend and contract and the extension length can be adjusted.

Patent Document 1:
Japanese Patent Application Laid-Open No. 2004-49619
Patent Document 2:
U.S. Pat. No. 3,244,437

DISCLOSURE OF THE INVENTION

Problems to be Solved by the Invention

To change the angle of the main body with respect to the handle in the cleaning tool described in the Patent Document 1, it is necessary to keep pushing in the button while the lock member is detached from the position where it was fitted in the fitting recessed portion and is fitted in the new recessed portion. Further, it is not easy to temporarily lock the handle in the plurality of angle positions corresponding to the plurality of recessed portions in order to easily select a suitable angle between the handle and the main body.

The button protruding outward from the side face of the handle for the pushing-in operation ruins a compact outward appearance (thickness and width) of the cleaning tool.

To select the suitable angle between the handle and the main body, a new recessed portion in which the lock member is to be fitted is searched for while pushing the button. Therefore, it is necessary to accurately rotate the handle and the main body a certain angle at one time so as to fit the lock member in each of the adjacent recessed portions. If the handle is extendable and is in a long state, it is difficult to accurately rotate the handle and the main body a certain angle at one time.

It is an object of the invention to easily change an angle of a main body with respect to a handle in a cleaning tool.

It is another object of the invention to make an outward appearance of the cleaning tool compact.

It is another object of the invention to easily change the angle of the main body with respect to the handle even when the handle of the cleaning tool is long.

The wand described in the Patent Document 2 has the following problems.

(1) Because the leaf spring is fixed to the outer face of the outer shaft forming the outward appearance of the wand, it ruins a design of the outward appearance and a user is likely to get caught on the leaf spring.

(2) The extension length of the outer shaft and the inner shaft can be fixed only in positions where the lock piece of the leaf spring is engaged in any of the lock holes. It is impossible to continuously adjust the extension length.

(3) Resilience of the leaf spring only provides the resilient property for engaging the lock piece into the lock hole in the lock rail on the outer face of the inner shaft from the window portion formed in the outer shaft. Therefore, the leaf spring does not have a function of preventing radial backlash of the outer shaft and the inner shaft.

(4) Because the leaf spring is fixed to the outer face of the outer shaft and has the operating portion to be operated from outside, the portion of the outer shaft to which the leaf spring is fixed cannot be housed in a hollow portion of another outer shaft having a larger diameter. Therefore, if three or more cylindrical members are inserted into each other to form a wand, a fully contracted length of the wand becomes long due to lengths of the leaf springs fixed to the respective outer shafts and the wand is not compact.

It is an object of the invention to provide a compact stick-like tool excellent in an outward appearance, continuously extendable, having no backlash, small in outside diameter, and small in a fully contracted length.

Means for Solving the Problems

According to the present invention, there is provided a cleaning tool, wherein a handle and a main body are pivoted on a pivot portion, recessed faces are provided at a plurality of positions of one of the handle and the main body in a rotating direction about the pivot portion, an engagement member provided to the other of the handle and the main body is biased toward the recessed faces so that the engagement member can resiliently move forward and backward to be repeatedly engaged in and detached from each of the adjacent recessed faces as a result of rotation of the handle and the main body, a lock piece provided to the other of the handle and the main body can be switched between a lock position and a lock release position, the lock piece positioned in the lock position butts against a stopper face of the engagement member to retain the engagement member in a position of engagement in the recessed face, and the lock piece positioned in the lock release position separates from the stopper face of the engagement member to allow the engagement member to resiliently move forward and backward.

According to the present invention, in a cleaning tool defined above, wherein the lock piece is mounted for sliding in a guide hole provided in a direction intersecting a forward and backward movement path of the engagement member in the other of the handle and the main body and includes an operating portion facing the outside from the other of the handle and the main body and a lock portion for coming in contact with and separating from the stopper face of the engagement member, a spring provided between the other of the handle and the main body and the lock piece biases the lock piece into the lock position and causes the lock portion of the lock piece positioned in the lock position to butts against the stopper face of the engagement member, and operation applied to the operating portion switches the lock piece to the lock release position and separates the lock portion of the lock piece positioned in the lock release position from the stopper face of the engagement member.

According to the present invention, in a cleaning tool defined above, wherein the engagement member includes a protruding face to be engaged in and detached from the recessed face, a constricted portion on an opposite side to the protruding face in a direction of forward and backward movements of the engagement member, and the stopper face at a middle portion of the constricted portion in the direction of the forward and backward movements of the engagement member, the lock piece is in a shape of a frame, the constricted portion of the engagement member is disposed in the frame of the lock piece, the lock portion provided to a portion of the frame of the lock piece butts against the stopper face of the engagement member when the lock piece is positioned in the lock position, and the lock portion of the lock piece separates from the stopper face of the engagement member to allow the constricted portion of the engagement member to move forward and backward in the frame of the lock piece when the lock piece is positioned in the lock release position.

According to the present invention, in a cleaning tool defined above, wherein the operating portion of the lock piece is disposed in an outer face recessed portion in the other of the handle and the main body.

According to the present invention, in a cleaning tool defined above, wherein the handle is extendable.

According to the present invention, there is provided a stick-like tool formed by inserting an inner shaft into a hollow portion of an outer shaft and connecting them so that they are extendible in an axial direction, wherein a spring member is sandwiched between an inner face of the outer shaft and an outer face of the inner shaft and the spring member is fixed to the outer shaft and resiliently brought into sliding contact with the outer face of the inner shaft.

According to the present invention, in the stick-like tool described above, wherein the spring member fixed to the outer shaft butts against and engages with a stopper portion provided to the inner shaft in an axial direction of the inner shaft at a fully extended end of the inner shaft with respect to the outer shaft.

According to the present invention, in the stick-like tool described above, wherein the spring member includes a short folded portion formed by folding one longitudinal end of a long main body portion at a folded rounded portion to one face side of the main body portion, a fulcrum portion made up of a bent rounded portion formed by bending a portion of the main body portion into a protruding shape on the one face side of the main body portion on the other end side in the longitudinal direction of the main body portion, and a working point portion made up of a bent rounded portion formed by bending a portion of the main body portion into a protruding shape on the other face side of the main body portion at a middle portion between the folded rounded portion of the main body portion and the bent rounded portion of the fulcrum portion, the longitudinal direction of the main body portion of the spring member is aligned with the axial directions of the outer shaft and the inner shaft, the folded portion is fixed to the outer shaft, the fulcrum portion is pushed against the inner face of the outer shaft, and the action point portion is resiliently brought into sliding contact with the outer face of the inner shaft.

According to the present invention, in the stick-like tool described above, wherein the bent rounded portion of the action point portion of the spring member fixed to the outer shaft is detachable locked to a fully extended lock portion of the outer face of the inner shaft at the fully extended end of the inner shaft with respect to the outer shaft.

According to the present invention, in the stick-like tool described above, wherein a latch portion provided to the folded portion of the spring member is fixedly locked to a fixing lock portion provided to the outer shaft.

According to the present invention, in the stick-like tool described above, wherein the spring member is provided on one side of centers of cross sections of the outer shaft and the inner shaft and a slide guide portion in which a V-shaped rib extending in the axial direction of the inner face of the outer shaft and a V-shaped groove extending in the axial direction of the inner shaft are engaged for sliding is provided on the other side.

BRIEF DESCRIPTION OF THE DRAWINGS

FIGS. 19(A) and 19(B) show a spring member, wherein FIG. 19(A) is a perspective view and FIG. 19(B) is a side view.

EXPLANATION OF REFERENCE NUMERALS

Figure 1:
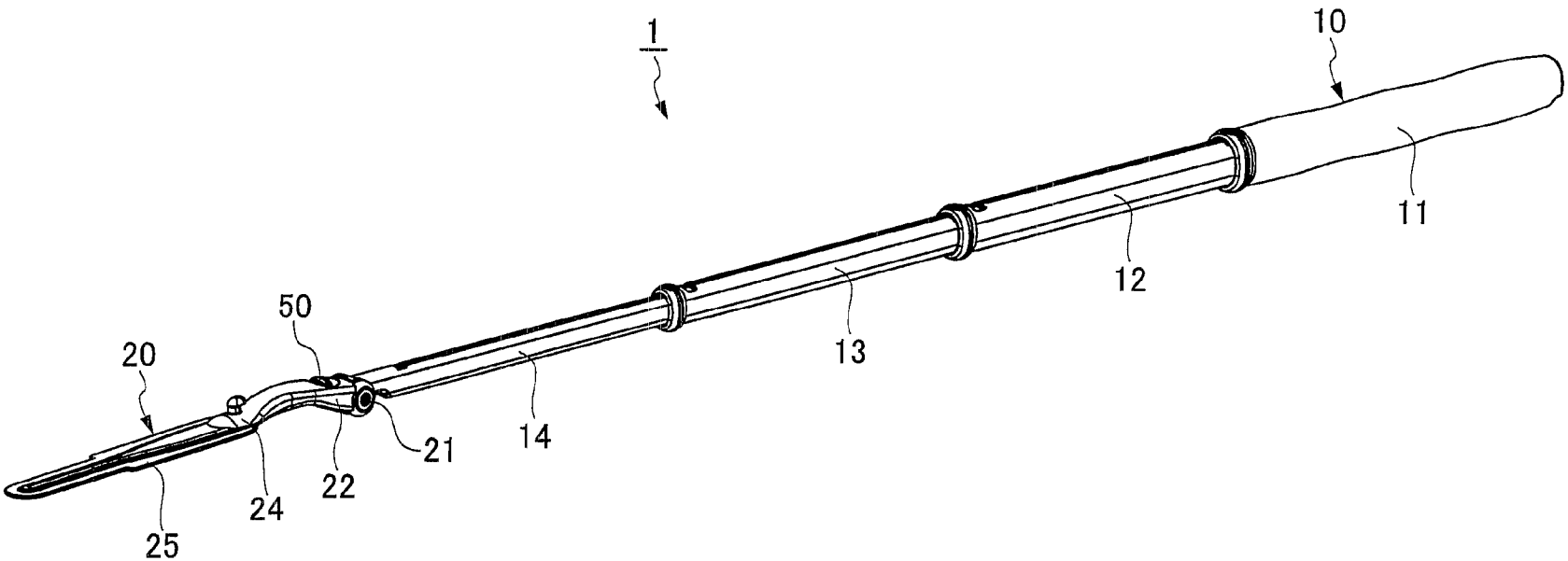
FIG. 1 is a perspective view of a cleaning tool.

1 cleaning tool
10 handle
20 main body
21 pivot portion
22A outer face recessed portion
36 recessed face
41 engagement member
41A protruding face
41C constricted portion
41D stopper face
50 lock piece
51 operating portion
52 lock portion
60 guide hole
61 spring
100 stick-like tool
101 slide guide portion
110 outer shaft
111 hollow portion
112 V-shaped rib
113 fixing lock portion
120 inner shaft
122 V-shaped groove
124 stopper portion
125 fully extended lock portion
130 spring member
131 main body portion
132 folded portion
132A latch portion
133 fulcrum portion
134 working point portion

DESCRIPTION OF THE PREFERRED EMBODIMENTS

An embodiment of the present invention will be described below based on the drawings.

Embodiment

Figure 2:
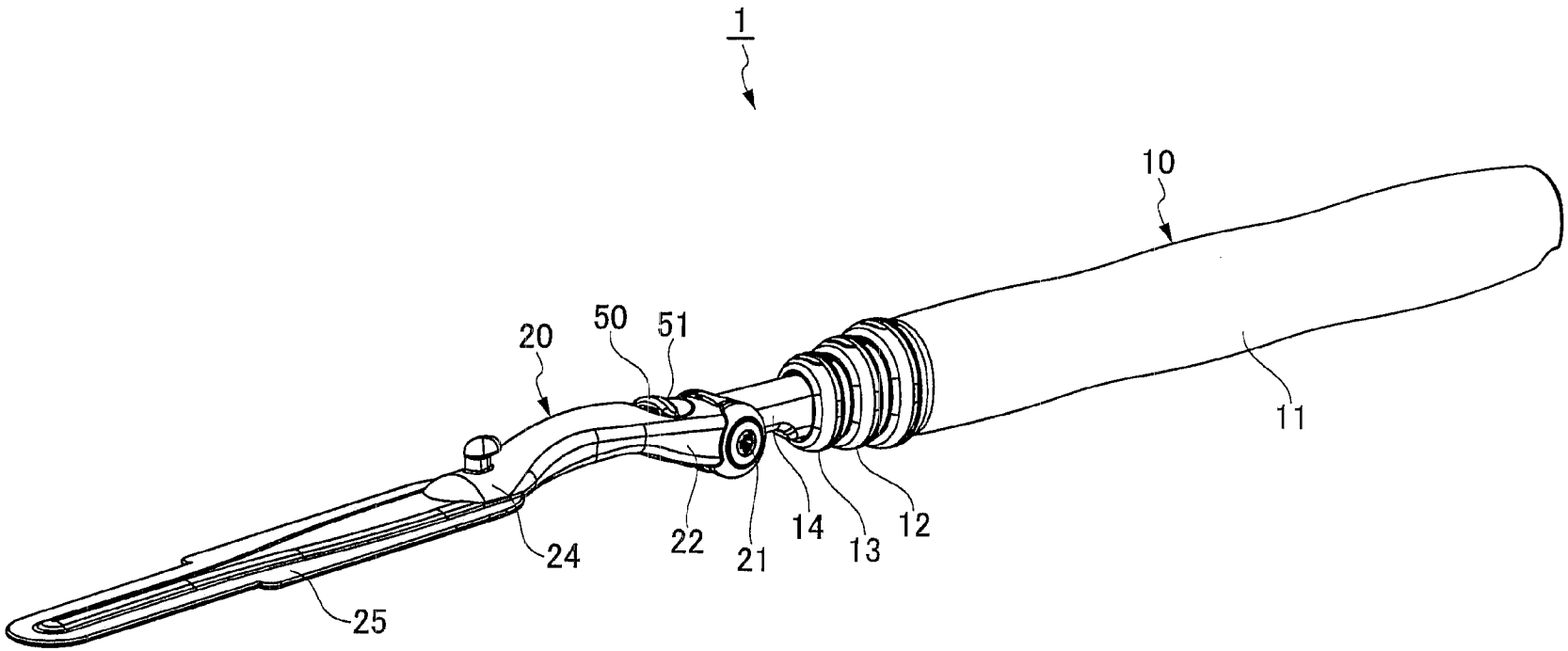
FIG. 2 is a perspective view of a fully contracted state of a handle of the cleaning tool.
Figure 3:
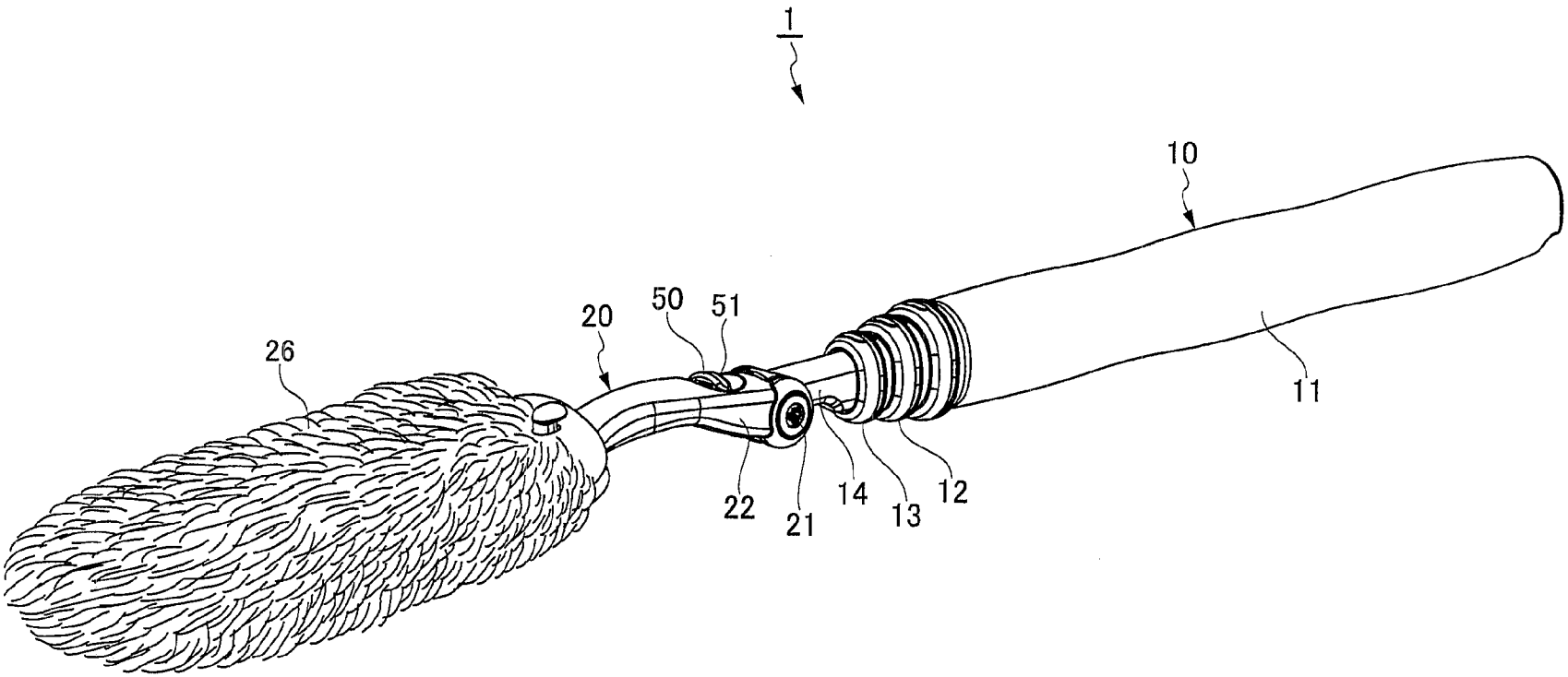
FIG. 3 is a perspective view of a state in which a cleaning sheet is attached to the cleaning tool.
Figure 4:
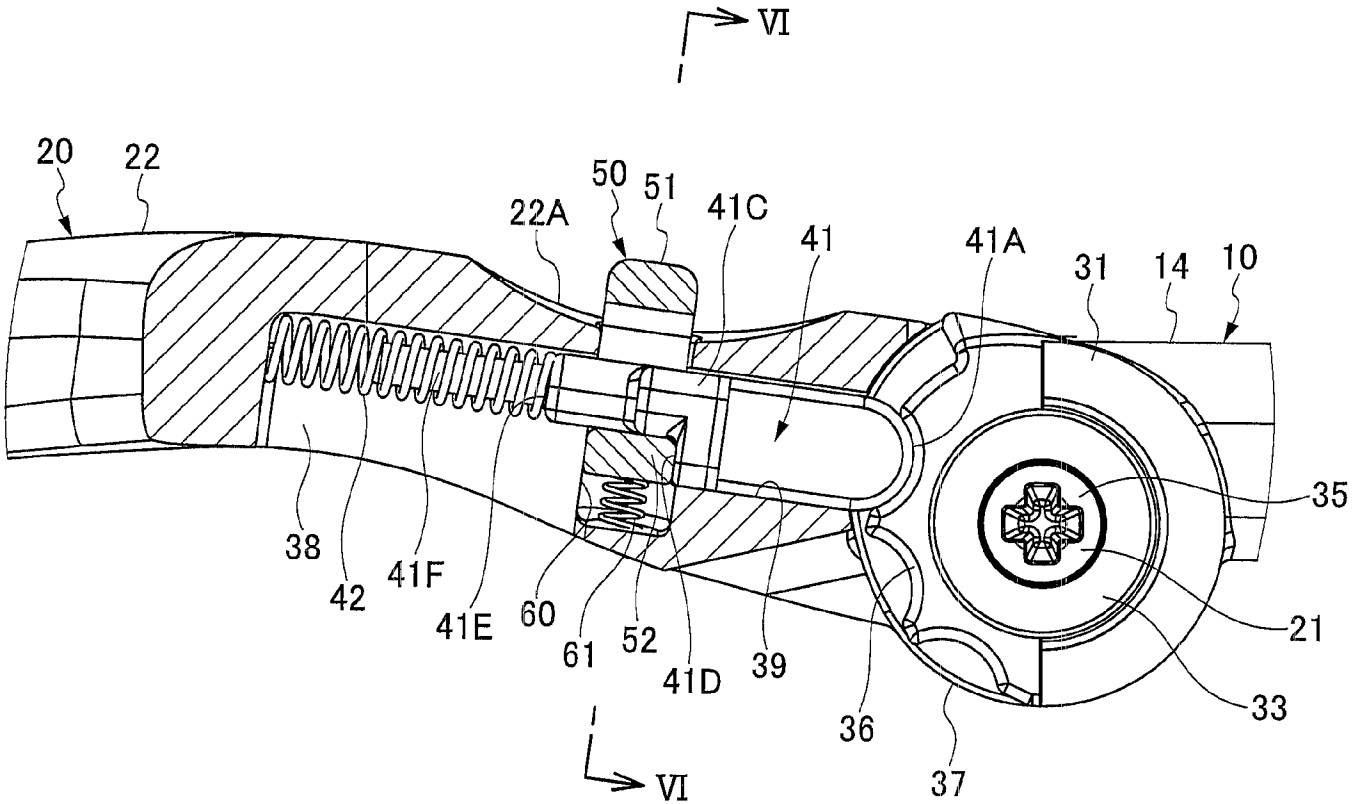
FIG. 4 is a sectional view of an adjusting structure of an angle between the handle and a main body.
Figure 5:
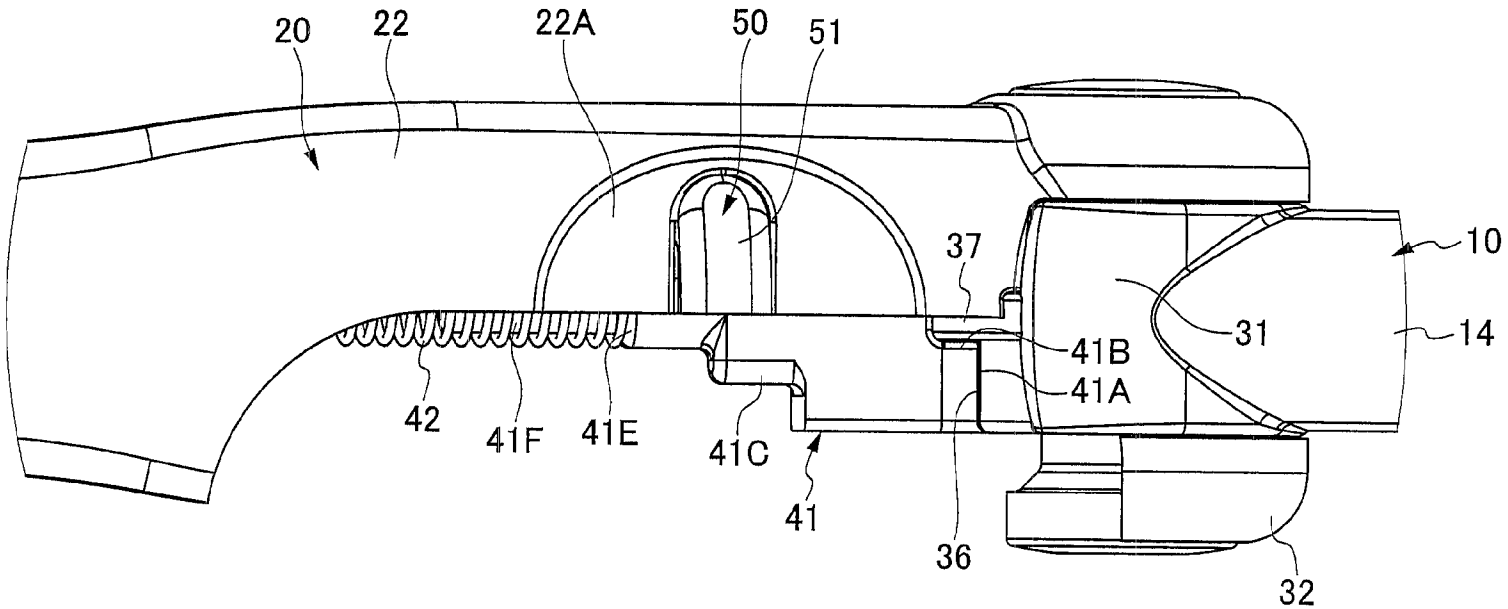
FIG. 5 is a cutaway plan view of a portion of FIG. 4.
Figure 6:
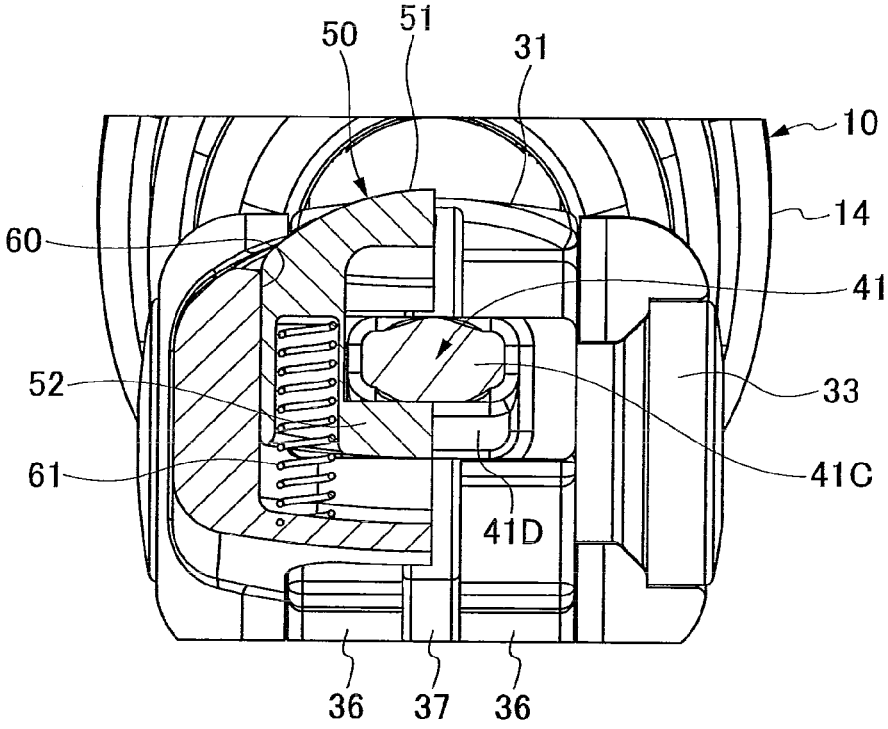
FIG. 6 is a sectional view along a line VI-VI in FIG. 4.
Figure 7:
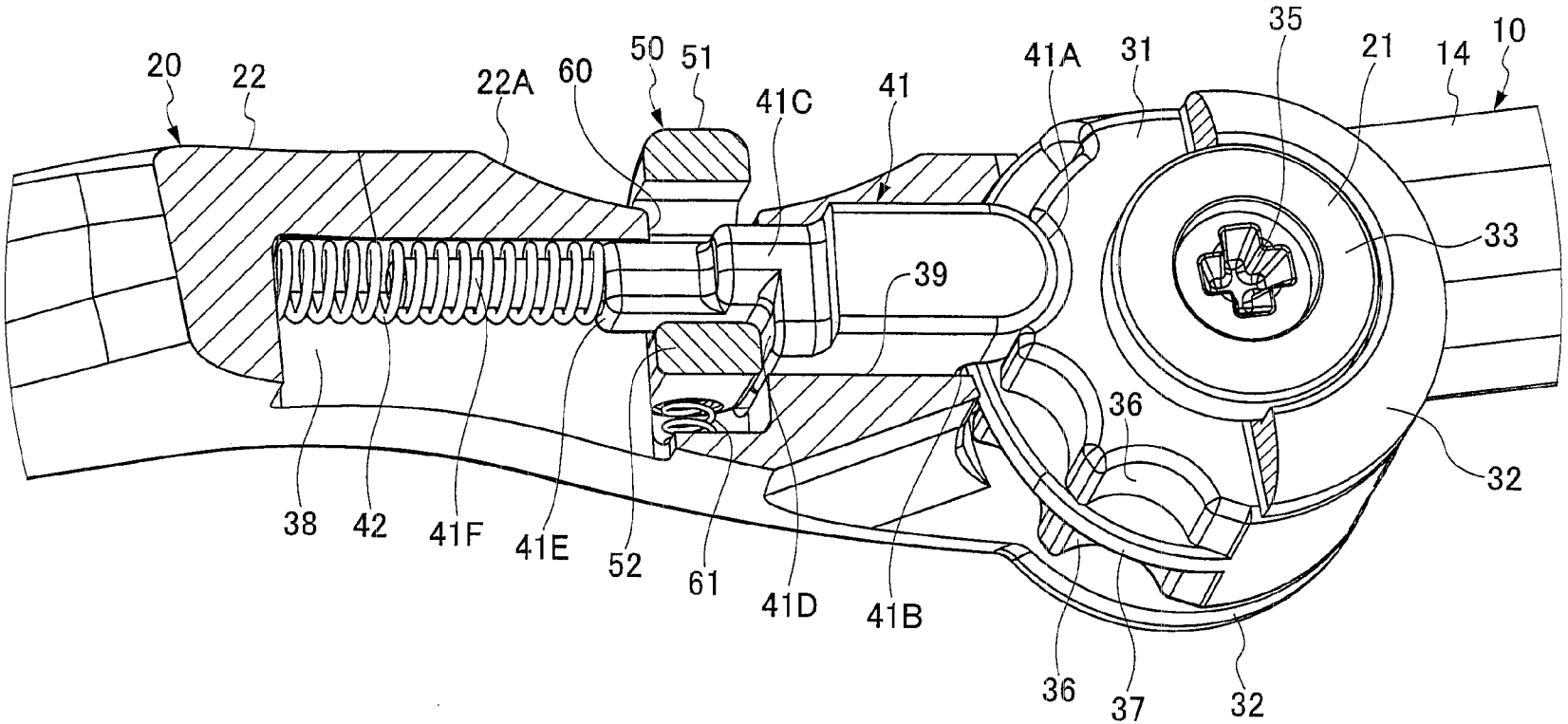
FIG. 7 is a sectional view showing a locked state of a lock piece.

As shown in FIGS. 1 to 3, a cleaning tool 1 is formed by connecting a main body 20 to a handle 10.

The handle 10 is formed by connecting a plurality of (four in the embodiment) shafts 11 to 14 in an extendable manner. The shaft 12 is inserted into a hollow portion of the shaft 11, the shaft 13 is inserted into hollow portion of the shaft 12, and the shaft 14 is inserted into a hollow portion of the shaft 13 in this order and the shafts are connected to be extendable in an axial direction. In this way, a cleaning head 24 of the main body 20 can be positioned near or far from hands of a user during use. FIG. 1 shows a fully extended state and FIG. 2 shows a fully contracted state.

The main body 20 is formed by pivoting an arm 22 on a front tip end portion (the shaft 14) of the handle 10 with a pivot portion 21 interposed therebetween, connecting the cleaning head 24 to a tip end portion of the arm 22, and detachably covering a mounting plate 25 of the cleaning head 24 with a cleaning sheet 26 (FIG. 3).

An adjusting mechanism of an angle between the handle 10 and the main body 20 (the arm 22 in the embodiment) will be described below (FIGS. 4 to 9).

The handle 10 and the arm 22 are pivoted on the pivot portion 21. A bifurcated mounting portion 32 of the arm 22 is fitted over a mounting portion 31 provided to a tip end portion of the shaft 14 of the handle 10. A rotation preventing sleeve 33 inserted into a mounting hole on a side of the mounting portion 32 is inserted from one side into a mounting hole 31A in the mounting portion 31 and engagement flat faces 33A similar to two parallel bolt faces of the rotation preventing sleeve 33 are engaged with engagement flat faces 31B in the mounting hole 31A to prevent rotation. A rotation preventing sleeve 34 inserted into a mounting hole on the other side of the mounting portion 32 is inserted from the other side into the mounting hole 31A in the mounting portion 31 and engagement flat faces 34A similar to two parallel bolt faces of the rotation preventing sleeve 34 are engaged with engagement flat faces 31B in the mounting hole 31A to prevent rotation. A setscrew 35 is inserted through a hollow portion of the rotation preventing sleeve 33 and a tip end thread portion of the setscrew 35 is engaged with an internal thread portion in the rotation preventing sleeve 34 to thereby mount the arm 22 on the mounting portion 31 of the shaft 14 for swinging.

At a plurality of positions on an outer peripheral face of the mounting portion 31 of the handle 10 in a rotating direction about the pivot portion 21 (setscrew 35), arc-shaped recessed faces 36 are formed. A partitioning portion 37 in a shape of a disk-shaped outer edge is provided at a central portion in a width direction (direction along an axial direction of the mounting hole 31A) of the outer peripheral face of the mounting portion 31 and left and right recessed faces 36, 36 are formed in the outer peripheral face on opposite sides of the partitioning portion 37.

An engagement member 41 provided to the arm 22 is biased toward the recessed faces 36 of the mounting portion 31 of the handle 10. When the handle 10 and the arm 22 are pivoted on the pivot portion 21, a compression coil spring 42 and an engagement member 41 are mounted in this order in a spring housing hole 38 and a guide hole 39 respectively formed in an axial direction on a central axis of the arm 22. The engagement member 41 receives a biasing force of the spring 42 and is guided by the guide hole 39 and resiliently biased toward the recessed faces 36 of the mounting portion 31 in such a manner that it can move forward and backward.

The engagement member 41 is provided, at a tip end portion in a direction of the forward and backward movements with respect to the recessed faces 36, with tip end protruding faces 41A to be engaged with and detached from the recessed faces 36 of the mounting portion 31. The engagement member 41 has a tip end depressed portion 41B for housing the partitioning portion 37 of the mounting portion 31 and the left and right protruding faces 41A on opposite sides of the depressed portion 41B and the left and right protruding faces 41A, 41A are engaged with and detached from the left and right recessed faces 36, 36 of the mounting portion 31. The engagement member 41 has a constricted portion 41C on an opposite side from the protruding faces 41A in the direction of the forward and backward movements with respect to the recessed faces 36, a stopper face 41D at a lower portion of a middle portion of the constricted portion 41C in the direction of the forward and backward movements, and a base end spring receiving face 41E at a base end portion in the direction of the forward and backward movements. The engagement member 41 is biased by the biasing force of the spring 42 with a protruding portion 41F protruding from the spring receiving face 41E inserted into an inside diameter portion of the spring 42, is guided by the guide hole 39, and pushes the protruding faces 41A against any of the recessed faces 36 of the mounting portion 31. If the user rotates the handle 10 and the arm 22 in such a manner as to bend them, the protruding faces 41A of the engagement member 41 resiliently move forward and backward to be repeatedly engaged with and detached from the respective adjacent recessed faces 36 while receiving the biasing force of the spring 42.

In other words, if the main body 20 is rotated with respect to the handle 10, the engagement member 41 of the main body 20 rotates with respect to the mounting portion 31. If the engagement member 41 rotates, the protruding faces 41A of the engagement member 41 are pushed back by the arc-shaped faces of the recessed faces 36 of the mounting portion 31 against the biasing force of the spring 42 and mounts a portion between the recessed faces 36 and the adjacent recessed faces 36 and the engagement member 41 resiliently moves backward along a lateral direction along an axial direction of the guide hole 39 (moves backward toward the spring 42). Then, if the engagement member 41 further rotates with respect to the mounting portion 31, the protruding faces 41A of the engagement member 41 resiliently enter the recessed faces 36 adjacent to the above recessed faces 36 in the rotating direction and the engagement member 41 resiliently moves forward in the lateral direction along the axial direction of the guide hole 39. As described above, if the main body 20 is rotated with respect to the handle 10, the protruding faces 41A of the engagement member 41 enter the adjacent recessed faces 36 while resiliently moving forward and backward in the lateral direction along the axial direction of the guide hole 39 so that the engagement protruding faces 41A and the recessed faces 36 can be engaged with and detached from each other.

Figure 8:
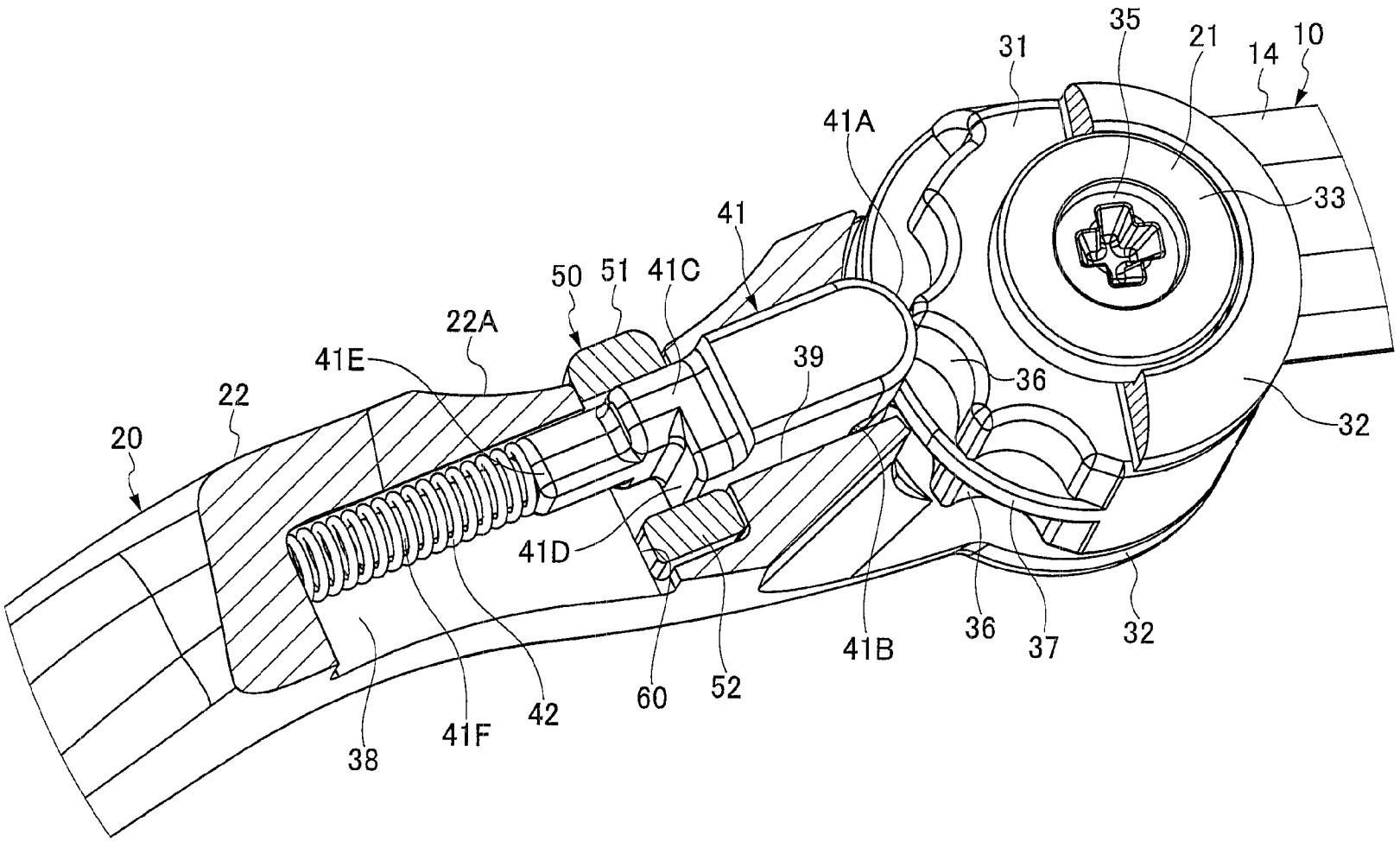
FIG. 8 is a sectional view showing a lock release state of the lock piece.
Figure 9:
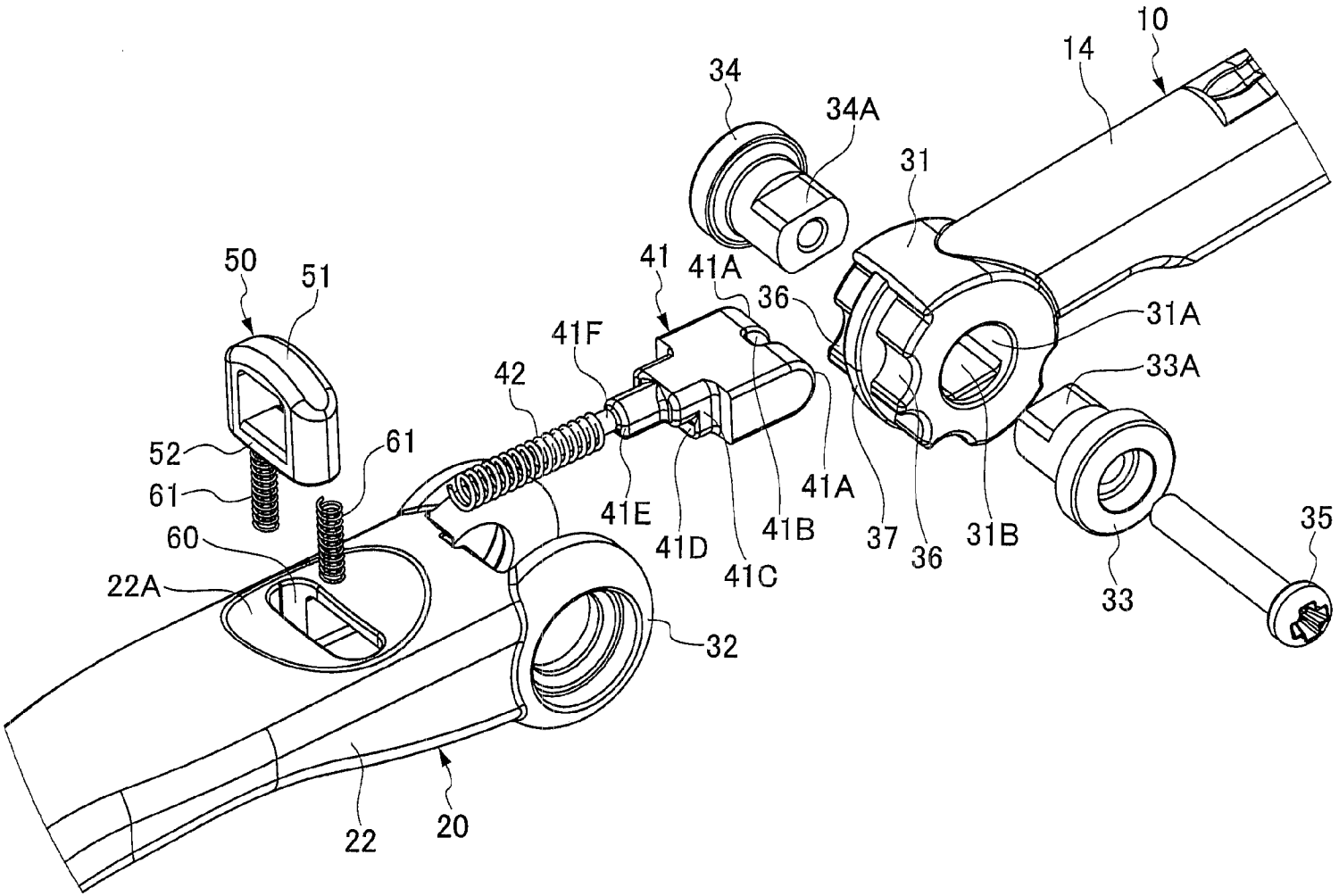
FIG. 9 is an exploded perspective view of the adjusting structure of the angle between the handle and the main body.

A lock piece (angle adjusting portion) 50 is provided around the pivot portion 21 between the shaft 14 and the arm 22 and the suitable angle between the handle 10 and the main body 20 can be changed easily by operating an operating portion 51 of the lock piece (angle adjusting portion) 50. The lock piece 50 is provided to the arm 22 of the main body 20. The lock piece 50 can be switched between a lock position (FIG. 7) and a lock release position (FIG. 8). The lock piece 50 positioned in the lock position butts against the stopper face 41D of the engagement member 41 and retains the protruding faces 41A of the engagement member 41 in the positions of engagement with the recessed faces 36 of the mounting portion 31 of the handle 10. The lock piece 50 positioned in the lock release position separates from the stopper face 41D of the engagement member 41 to allow the engagement member 41 to freely and resiliently move forward and backward as described above.

The lock piece 50 is mounted for sliding in a guide hole 60 formed between the spring housing hole 38 and the guide hole 39 in the arm 22 in a direction intersecting the forward and backward movement path of the engagement member 41 and in a direction orthogonal to the central axis of the arm 22 in the embodiment. The lock piece 50 includes the operating portion 51 facing the outside from the arm 22 and a lock portion 52 for coming in contact with and separating from the stopper face 41D of the engagement member 41. In the embodiment, the operating portion 51 is disposed on an outer face recessed portion 22A on a curved face of the arm 22.

Between a bottom face of the guide hole 60 of the arm 22 and the lock piece 50, left and right two compression springs 61, 61 are provided. The springs 61 bias the lock piece 50 into the lock position (FIG. 7) and cause the lock portion 52 of the lock piece 50 positioned in the lock position to butt against the stopper face 41D of the engagement member 41. By pushing in the operating portion 51, the lock piece 50 is switched to the lock release position (FIG. 8) against biasing forces of the springs 61 to separate the lock portion 52 of the lock piece 50 positioned in the lock release position from the stopper face 41D of the engagement member 41.

Specifically, the lock piece 50 is in a shape of a square frame (FIG. 9), and the constricted portion 41C of the engagement member 41 extending between the spring housing hole 38 and the guide hole 39 in the arm 22 is disposed in the frame of the lock piece 50 when the lock piece 50 is mounted for sliding in the guide hole 60 in the arm 22. An upper frame of the square frame of the lock piece 50 serves as the operating portion 51 and a lower frame serves as the lock portion 52. Upper ends of the springs 61 are inserted into holes formed from below in left and right vertical frames of the lock piece 50. If the lock piece 50 is positioned in the lock position (FIG. 7) by the springs 61, the lock portion 52 as the lower frame of the lock piece 50 butts against the stopper face 41D of the engagement member 41. If the lock piece 50 is positioned in the lock release position (FIG. 8) by pushing-in operation of the operating portion 51 as the upper frame, the lock portion 52 as the lower frame of the lock piece 50 separates downward from the stopper face 41D of the engagement member 41 to allow the constricted portion 41C of the engagement member 41 to freely move forward and backward in the frame of the lock piece 50.

Therefore, in the cleaning tool 1, if the lock piece 50 is positioned in the lock position (FIG. 7) by the biasing forces of the springs 61, the lock portion 52 of the lock piece 50 butts against the stopper face 41D of the engagement member 41, stops the forward and backward movements of the engagement member 41 engaged with any of the recessed faces 36 of the mounting portion 31 of the handle 10, and locks the angle between the arm 22 provided with the engagement member 41 and the handle 10. On the other hand, if the lock piece 50 is positioned in the lock release position (FIG. 8) by the pushing-in operation of the operating portion 51, the lock portion 52 of the lock piece 50 separates from the stopper face 41D of the engagement member 41 to allow the engagement member 41 to freely move forward and backward. As the handle 10 and the arm 22 rotate, the engagement member 41 can resiliently move forward and backward to be repeatedly engaged with and detached from the respective adjacent recessed faces 36 of the mounting portion 31 of the handle 10, the handle 10 can be temporarily locked at arbitrary angle positions in order, and a suitable angle can be selected.

In the cleaning tool 1, it is essential only that the recessed faces 36 be provided to one of the handle 10 and the main body 20 (arm 22) and that the engagement member 41, the lock piece 50, and the like be provided to the other.

The embodiment exerts the following effects.

(a) To change the angle of the main body 20 with respect to the handle 10, the lock piece 50 is switched to the lock release position. In this way, the lock piece 50 separates from the stopper face 41D of the engagement member 41 to allow the engagement member 41 to resiliently move forward and backward. As a result, if the main body 20 is rotated with respect to the handle 10, the engagement member 41 can resiliently move forward and backward to be engaged with and detached from the respective adjacent recessed faces 36. Therefore, the handle 10 can be temporarily locked at the plurality of angle positions corresponding to the plurality of recessed faces 36 in order and the suitable angle between the handle 10 and the main body 20 can be selected easily. When the suitable angle between the handle 10 and the main body 20 is selected, the lock piece 50 is switched to the lock position. In this way, the lock piece 50 butts against the stopper face 41D of the engagement member 41 to retain the engagement member 41 in the position of engagement with the recessed faces 36 and lock the angle between the handle 10 and the main body 20.

(b) The springs 61 provided between the main body 20 and the lock piece 50 bias the lock piece 50 into the lock position and the lock portion 52 of the lock piece 50 positioned in the lock position butts against the stopper face 41D of the engagement member 41. On the other hand, the lock piece 50 is switched to the lock release position by the operation of the operating portion 51 and the lock portion 52 of the lock piece 50 positioned in the lock release position separates from the stopper face 41D of the engagement member 41. Therefore, to change the angle of the main body 20 with respect to the handle 10, it is necessary to operate the operating portion 51 to switch the lock piece 50 to the lock release position. However, when the suitable angle between the handle 10 and the main body 20 is selected, the hand may be released from the operating portion 51 and the springs 61 bias and position the lock piece 50 into the lock position.

(c) The lock piece 50 is formed in the frame shape and the constricted portion 41C of the engagement member 41 is disposed in the frame of the lock piece 50. As a result, the lock piece 50 and the engagement member 41 can be compactly mounted in the handle 10 or the main body 20.

(d) The operating portion 51 of the lock piece 50 is disposed in the outer face recessed portion 22A of the main body 20. Therefore, the lock piece 50 does not protrude outward from the side face of the handle 10 or the main body 20 due to the pushing-in operation. It is possible to make the outward appearance (thickness and width) of the cleaning tool 1 compact and the cleaning tool 1 can be inserted into and used in a narrower space.

(e) As described in (a), by switching the lock piece 50 to the lock release position and merely rotating the main body 20 with respect to the handle 10, the engagement member 41 can resiliently move forward and backward to be engaged with and detached from the respective adjacent recessed faces 36 and the suitable angle between the handle 10 and the main body 20 can be selected easily. Even when the handle 10 is extendable and is in a long state, the handle 10 and the main body 20 need not be accurately rotated a certain angle at one time and it is possible to easily find new recessed faces 36 with which the engagement member 41 is to be engaged.

A stick-like tool 100 that is the handle 10 of the cleaning tool 1 will be described below. In the stick-like tool 100, a first shaft 11 and a second shaft 12 form an outer shaft 110 and an inner shaft 120 of the invention and connected to each other, the second shaft 12 and a third shaft 13 form the outer shaft 110 and the inner shaft 120 of the invention and connected to each other, and the third shaft 13 and a fourth shaft 14 form the outer shaft 110 and the inner shaft 120 of the invention and connected to each other. The outer shafts and inner shafts forming pairs in the invention will be described as 110 and 120 (FIGS. 10 to 18).

Figure 10:
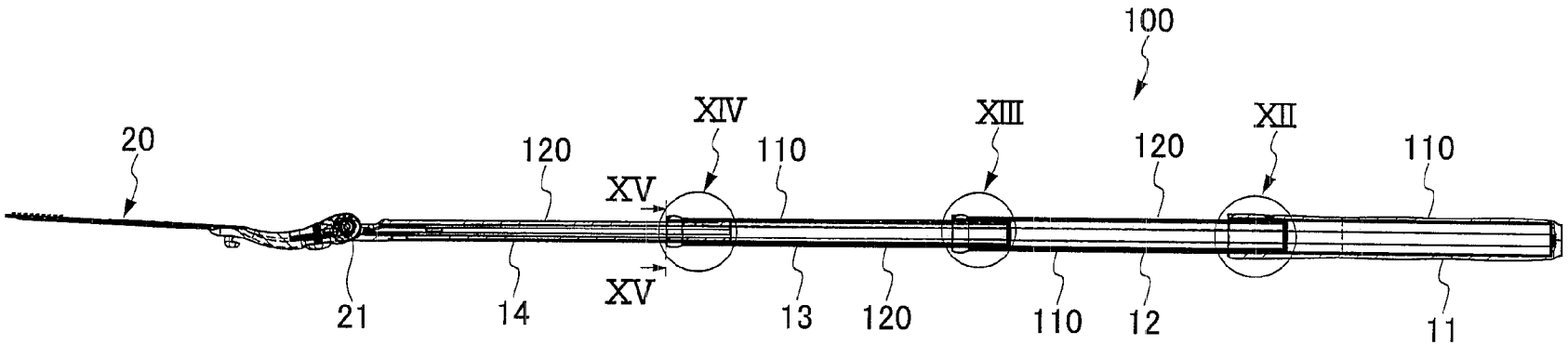
FIG. 10 is a sectional view showing a fully extended state of the handle.
Figure 11:
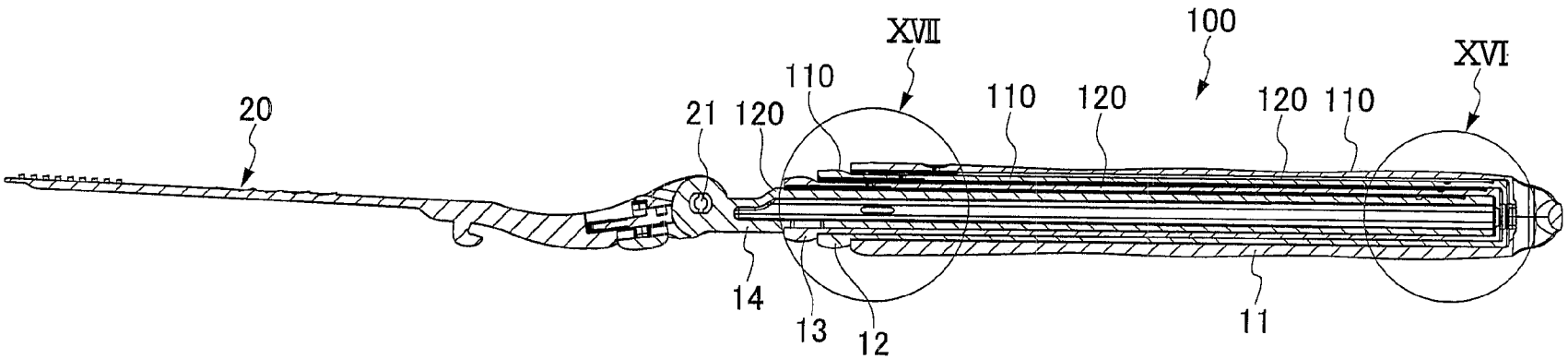
FIG. 11 is a sectional view showing a fully contracted state of the handle.

The stick-like tool 100 is formed by inserting inner shafts 120 into hollow portions 111 of the outer shafts 110 and connecting them so that they are extendable in an axial direction as shown in FIGS. 10 and 11. In the stick-like tool 100, an opening 111A of the hollow portion 111 is formed in a tip end of the outer shaft 110 and a bottom 111B of the hollow portion 111 is formed at a base end of the outer shaft 110. In the stick-like tool 100, the inner shaft 120 can be pushed into the hollow portion 111 from the opening 111A in the tip end of the outer shaft 110 and an outer face bulging portion 121A of an outer face bulging thick portion 121 at the tip end of the inner shaft 120 is brought in contact with an end face of the opening 111A of the outer shaft 110 to stop a pushed-in end.

Figure 15:
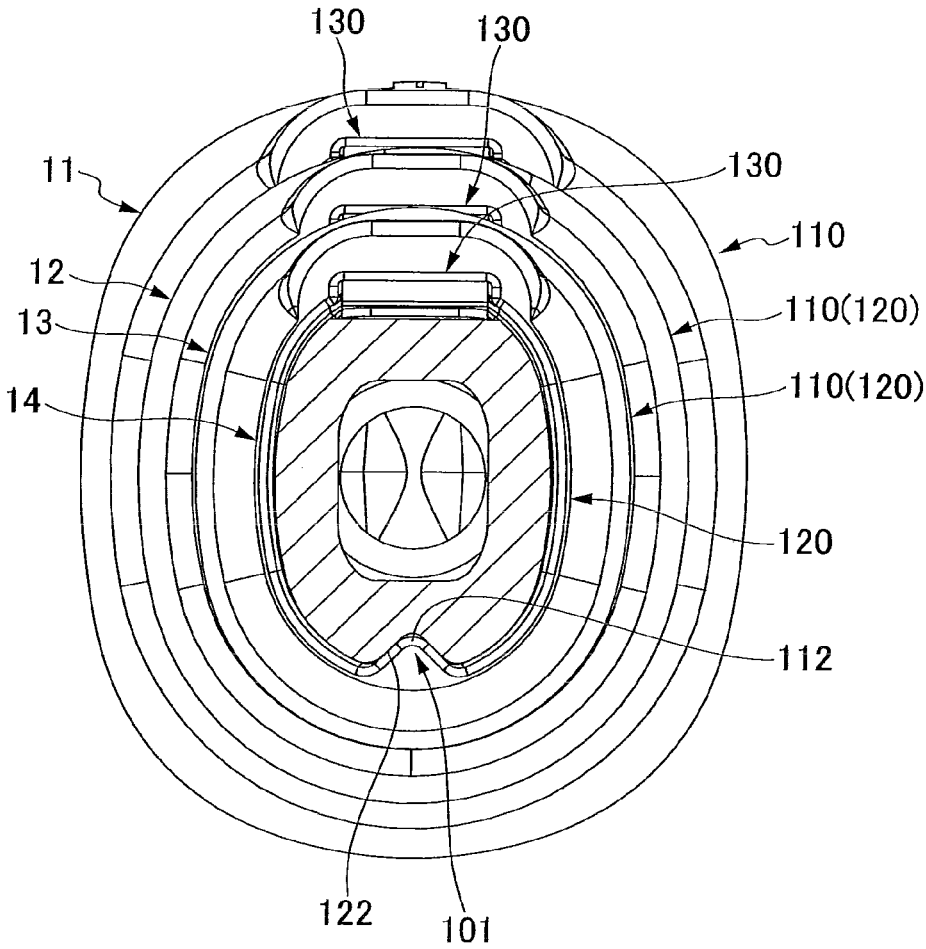
FIG. 15 is a sectional view along a line XV-XV in FIG. 10.
Figure 16:
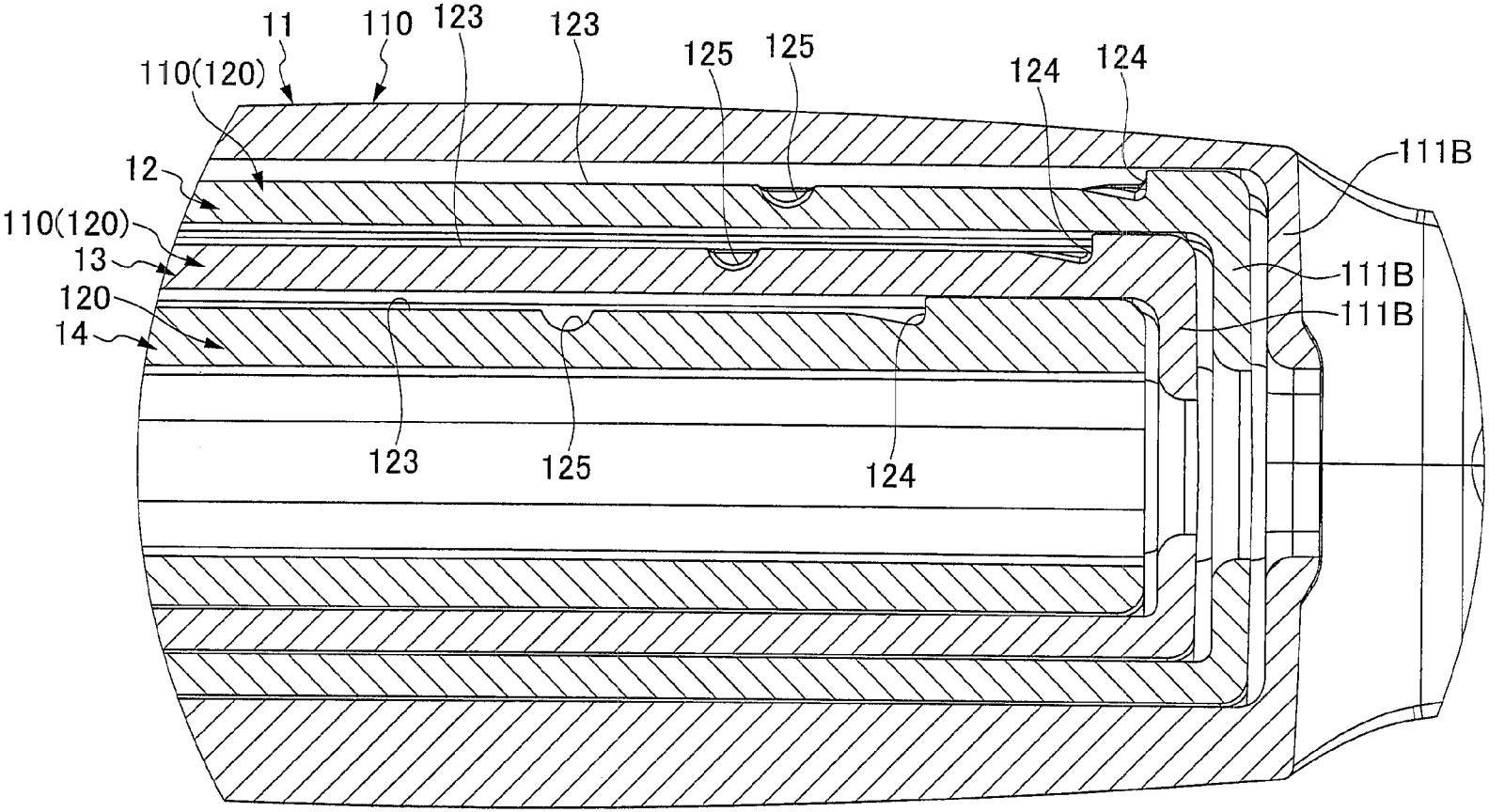
FIG. 16 is an enlarged sectional view of a portion XVI in FIG. 11.
Figure 17:
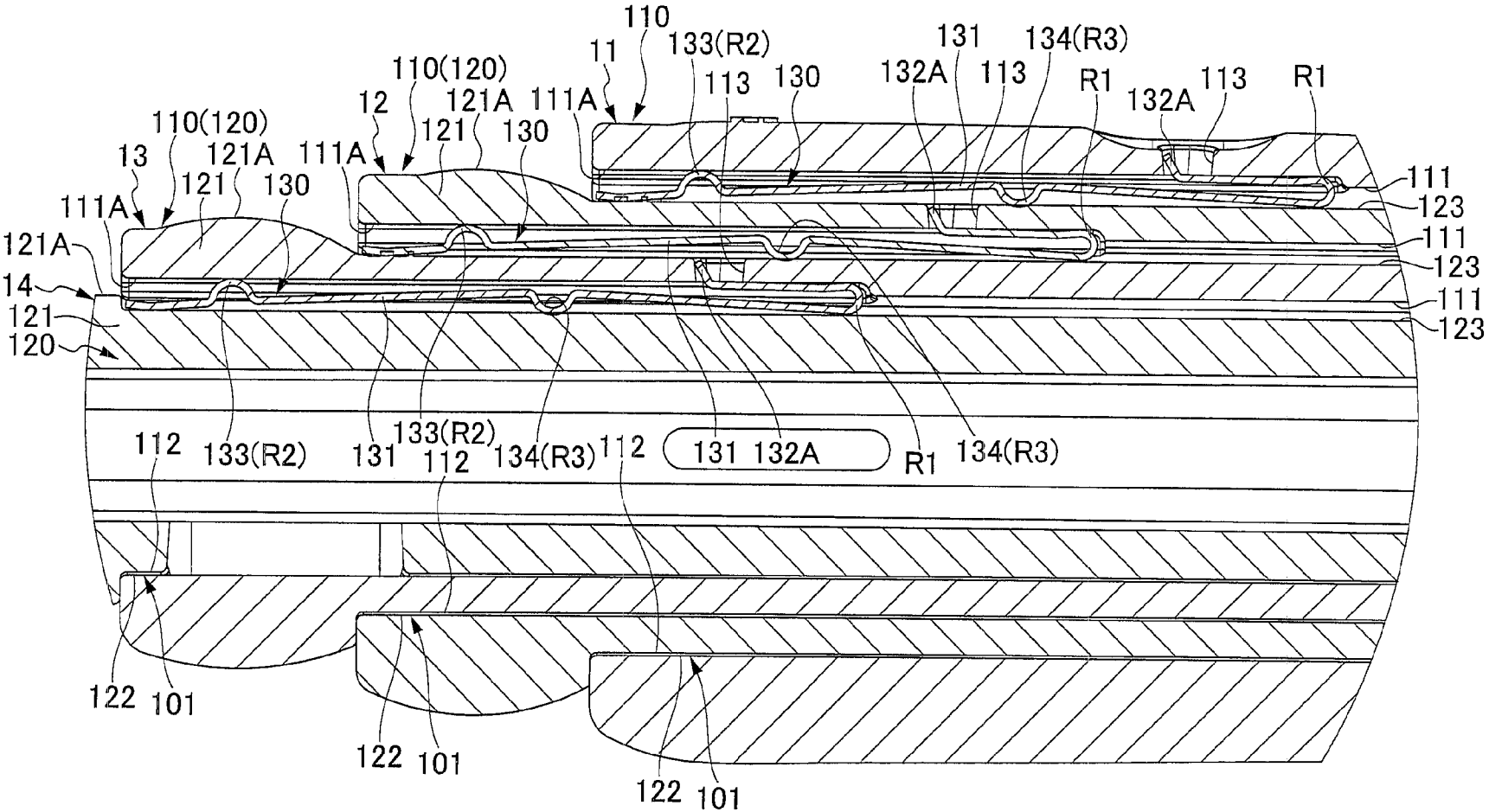
FIG. 17 is an enlarged sectional view of a portion XVII in FIG. 11.

As shown in FIG. 15, the stick-like tool 100 includes a slide guide portion 101 formed by engaging a V-shaped rib 112 extending in an axial direction of an inner face of the outer shaft 110 and a V-shaped groove 122 extending in an axial direction of an outer face of the inner shaft 120 for sliding with respect to each other.

In the embodiment, the stick-like tool 100 is provided, on a lower side of centers of cross sections of the outer shaft 110 and the inner shaft 120, with the above-described slide guide portion 101 in the state in FIGS. 10 and 11 where the stick-like tool 100 is disposed with a bottom face of the cleaning head 24 of the cleaning tool 1 facing upward in a vertical direction. The stick-like tool 100 is preferably used after applying a lubricant of a suitable viscosity to the V-shaped rib 112 and the V-shaped groove 122 of the slide guide portion 101.

In the stick-like tool 100, as shown in FIGS. 12 to 17, a spring member 130 is sandwiched between the inner face of the outer shaft 110 and the outer face of the inner shaft 120, fixed to the outer shaft 110, and resiliently brought into sliding contact with the outer face of the inner shaft 120. In the embodiment, the stick-like tool 100 is provided, on the other sides (upper sides in FIGS. 10 and 11) of the centers of the cross sections of the outer shaft 110 and the inner shaft 120 with respect to the slide guide portion 101, with the spring member 130.

Figure 19A:
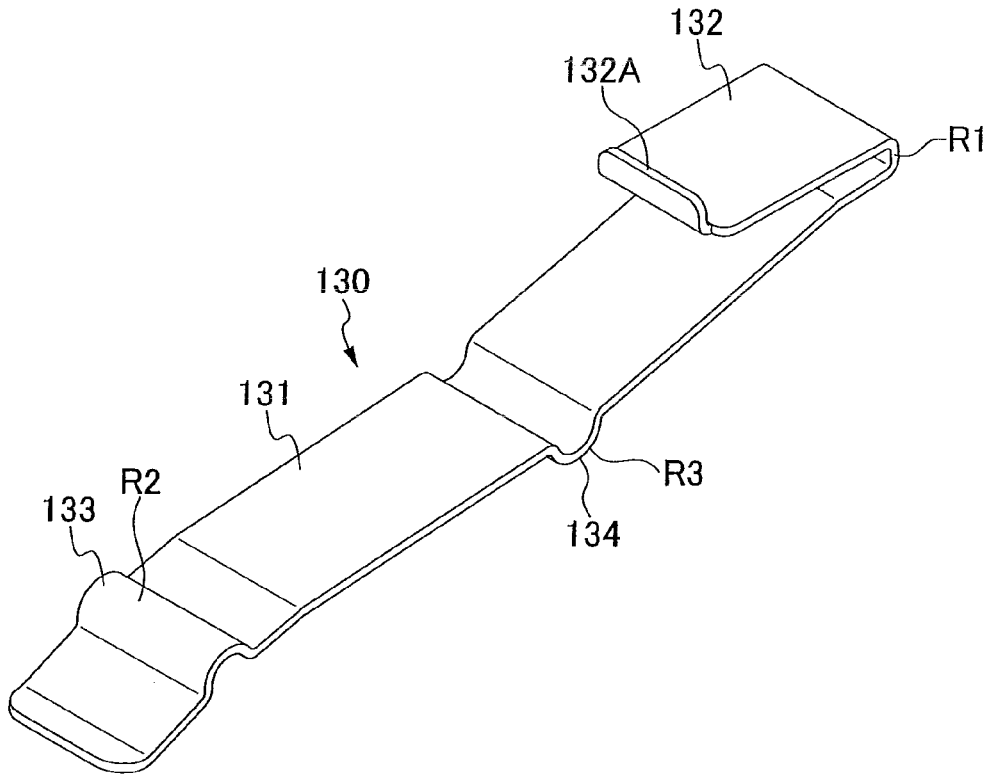
Figure 19B:
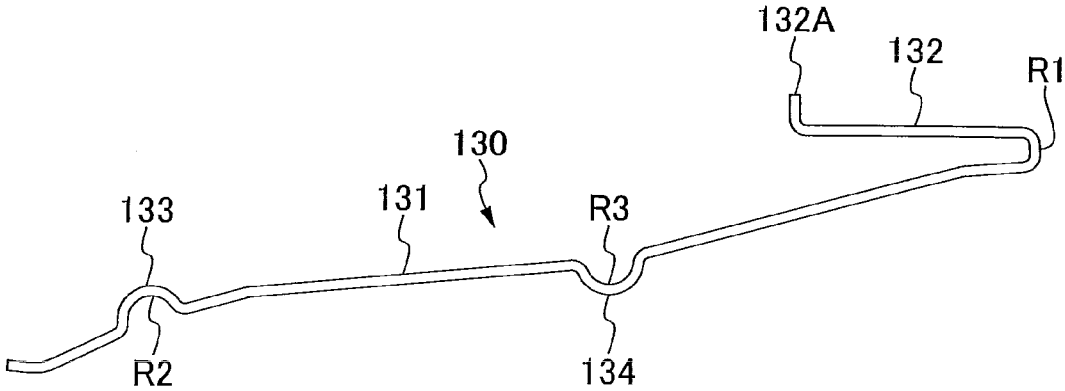

As shown in FIG. 19, the spring member 130 is provided, at a base end of a long main body portion 131, with a short folded portion 132 formed by folding the base end toward one face side (upper face side in FIG. 19) of the main body portion 131 at a folded rounded portion (R1). The spring member 130 is provided, on a tip end side (at a portion at a certain distance from a tip end portion of the main body portion 131 toward the base end) of the main body portion 131, with a fulcrum portion 133 made up of a bent rounded portion (R2) formed by bending the portion of the main body portion 131 into a protruding shape on the one face side (upper face side in FIG. 19) of the main body portion 131. The spring member 130 is provided, at a middle portion between the folded rounded portion (R1) of the main body portion 131 and a bent rounded portion (R2) of the fulcrum portion 133, with a working point portion 134 made up of a bent rounded portion (R3) formed by bending a portion of the main body portion 131 into a protruding shape on the other face side (lower face side in FIG. 19) of the main body portion 131. In the embodiment, the spring member 130 is made up of a leaf spring.

In the stick-like tool 100, as shown in FIGS. 12 to 18, a longitudinal direction of the main body portion 131 of the spring member 130 is aligned with axial directions of the outer shaft 110 and the inner shaft 120, the folded portion 132 is fixed to the outer shaft 110, the fulcrum portion 133 is pushed against the inner face of the outer shaft 110, and the working point portion 134 is resiliently brought in sliding contact with the outer face of the inner shaft 120. In the stick-like tool 100, a flat groove is formed on a side of the inner shaft 120 in contact with the spring member 130, i.e., the opposite side to the V-shaped groove 122 so that a shape of the spring member 130 agrees with an outline of the working point portion 134 where the spring member 130 comes in contact with the inner shaft 120. In the embodiment, the spring member 130 is made up of the leaf spring and the working point portion 134 resiliently comes in sliding contact with a flat slide portion 123 provided from a tip end side to a base end side in the axial direction of the outer face of the inner shaft 120 (FIG. 15).

In the stick-like tool 100, a latch portion 132A is formed at a tip end of the folded portion 132 of the spring member 130 (FIG. 19) and the latch portion 132A is fixedly locked to a hole-shaped (or groove-shaped) fixing lock portion 113 formed in the hollow portion 111 of the outer shaft 110 to thereby fix the spring member 130 to the outer shaft 110.

Figure 12:
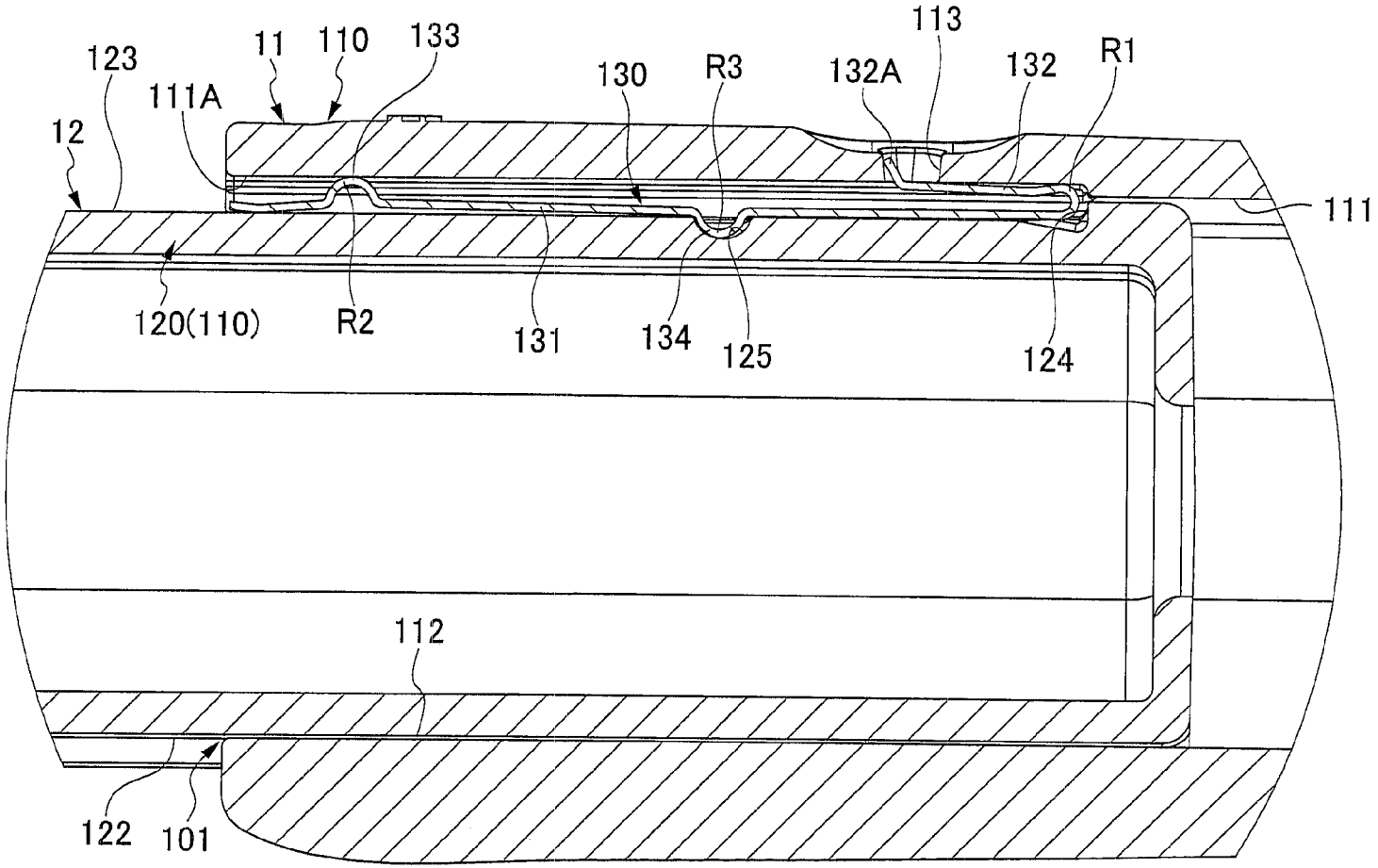
FIG. 12 is an enlarged sectional view of a portion XII in FIG. 10.
Figure 13:
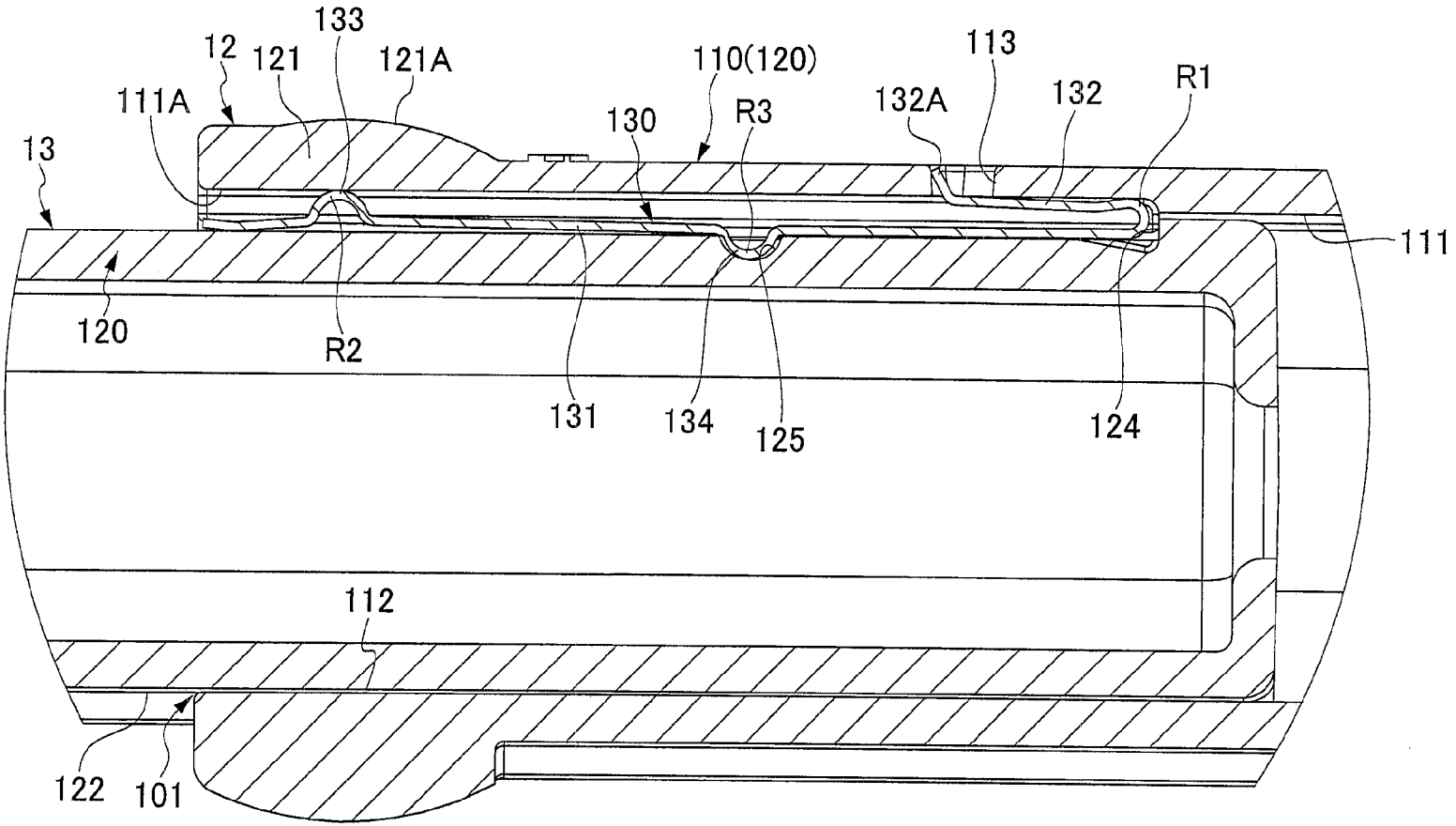
FIG. 13 is an enlarged sectional view of a portion XIII in FIG. 10.
Figure 14:
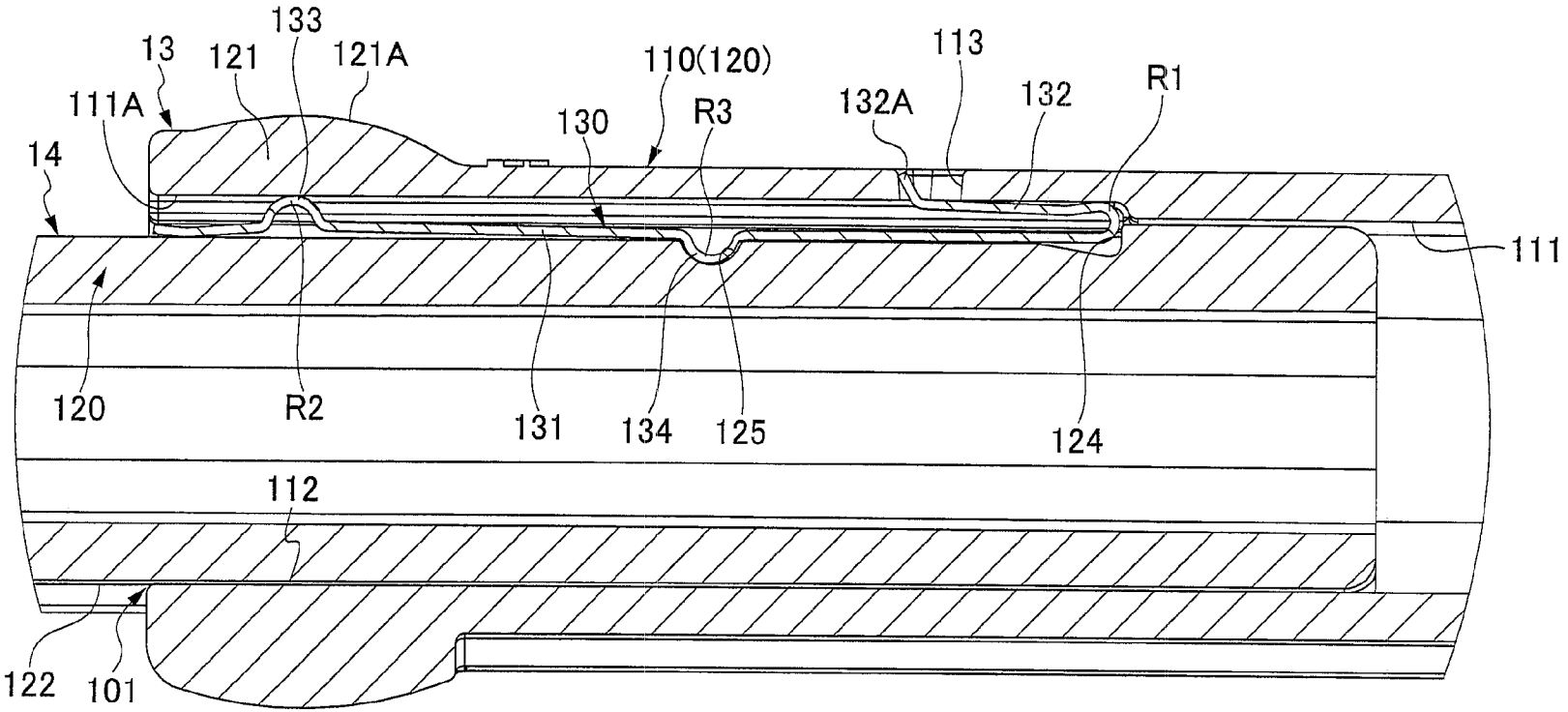
FIG. 14 is an enlarged sectional view of a portion XIV in FIG. 10.

In the stick-like tool 100, the spring member 130 fixed to the outer shaft 110, which is the folded portion 132 of the spring member 130 in the embodiment, butts against and engages with the stopper portion 124 provided to the inner shaft 120 in the axial direction of the inner shaft 120 at a fully extended end of the inner shaft 120 with respect to the outer shaft 110 as shown in FIGS. 12 to 14. The stopper portion 124 is made up of a rising wall rising at an end on a base end side of the flat slide portion 123 of the inner shaft 120.

In the stick-like tool 100, the bent rounded portion (R3) of the working point portion 134 of the spring member 130 fixed to the outer shaft 110 is locked to a fully extended lock portion 125 on the outer face of the inner shaft 120 at the fully extended end of the inner shaft 120 with respect to the outer shaft 110. The fully extended lock portion 125 is formed in a recessed shape at a position in the flat slide portion 123 of the inner shaft 120 corresponding to the working point portion 134 of the spring member 130 when the folded portion 132 of the spring member 130 fixed to the outer shaft 110 butts against and engages with the stopper portion 124 of the inner shaft 120. The working point portion 134 of the spring member 130 resiliently falls into and is locked to the fully extended lock portion 125 of the inner shaft 120.

In the stick-like tool 100, an outer face bulging portion 121A of an outer face bulging thick portion 121 at the tip end of the inner shaft 120 butts against and engages with an end face of the opening 111A of the outer shaft 110 at a pushed-in end of the inner shaft 120 with respect to the outer shaft 110.

Figure 18:
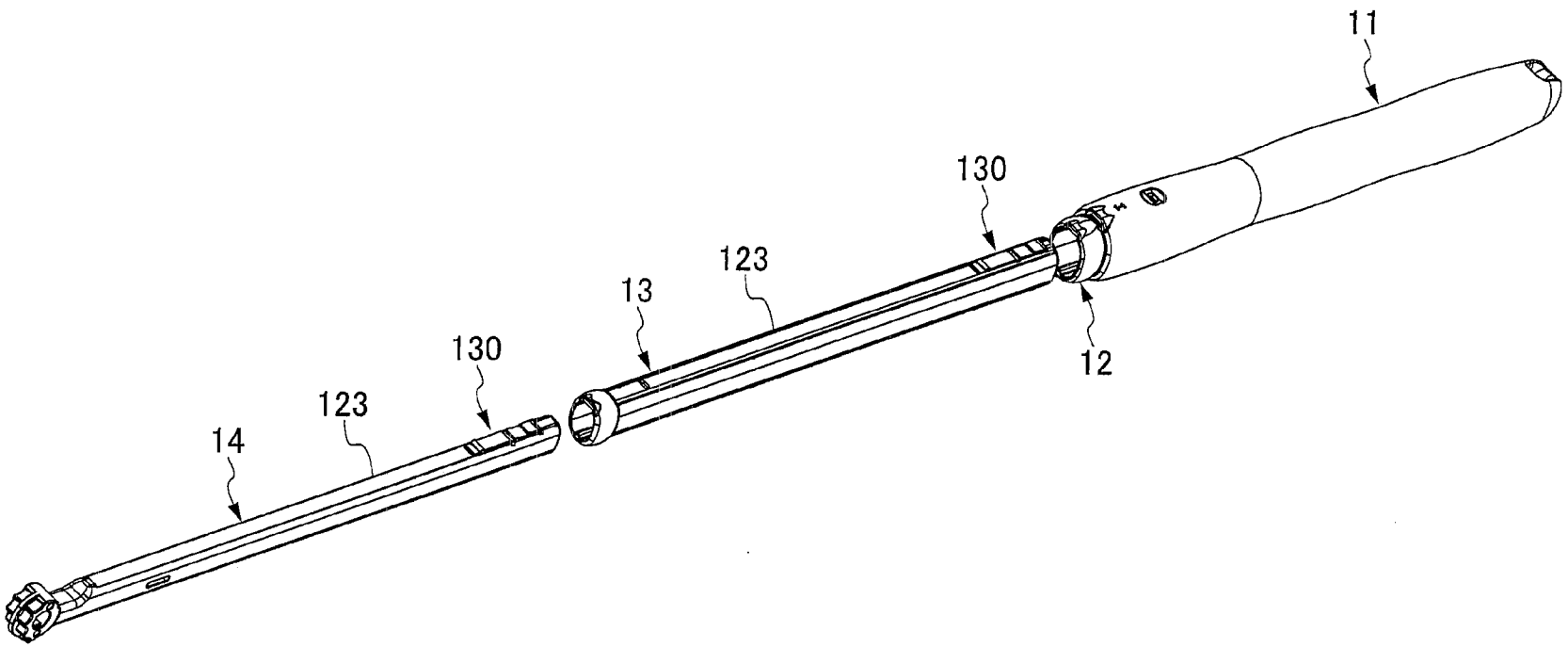
FIG. 18 is a perspective view showing an assembly process of the handle.

In assembly of the stick-like tool 100, as shown in FIG. 18, with folded portion 132 and the working point portion 134 of the spring member 130 retained in the stopper portion 124 and the fully extended lock portion 125 of the inner shaft 120, respectively, the spring member 130 and the inner shaft 120 are inserted into the hollow portion 111 of the outer shaft 110 from the opening 111A. When the latch portion 132A of the folded portion 132 of the spring member 130 reaches the hole of the fixing lock portion 113 of the outer shaft 110, the latch portion 132A resiliently falls into and is fixedly locked to the fixing lock portion 113 from an inner face of the hollow portion 111 due to the resilience of the folded portion 132 to thereby complete the assembly.

The stick-like tool 100 is assembled by inserting the outer shaft 110 and the inner shaft 120 into each other. If three or more shafts 11 to 14 are assembled, the shafts 11 to 14 may be assembled in any order (from the smallest-diameter shaft, the largest-diameter shaft, or the intermediate one).

Because the inner shaft 120 is inserted from the opening 111A at the tip end of the outer shaft 110 in the assembly, it is possible to assemble even if the cleaning head 24 or the like is integrally provided to the tip end of the inner shaft 120.

The tip end of the inner shaft 120 may be formed as the outer face bulging thick portion 121 to thereby obtain bending strength of the outer shaft 110 and the inner shaft 120 against a bending force or the like applied to the stick-like tool 100.

According to the embodiment, the following effects are exerted.

(a) The spring member 130 is housed between the outer shaft 110 and the inner shaft 120 and is not provided on the outer face of the outer shaft 110. Therefore, the stick-like tool 100 is excellent in the design of the outward appearance and there is no such disadvantage that the user gets caught on the spring member 130.

(b) The spring member 130 resiliently comes in sliding contact with the outer face of the inner shaft 120 and can fix the outer shaft 110 and the inner shaft 120 at an arbitrary extension length with its resilience. The extension length can be adjusted continuously.

(c) The spring member 130 is fixed to the inner face of the outer shaft 110 and resiliently comes in sliding contact with the outer face of the inner shaft 120. The spring member 130 fixes, with its resilience, the outer shaft 110 and the inner shaft 120 not only in the axial direction (extension direction) but also in the radial direction and prevents axial and radial backlash of the outer shaft 110 and the inner shaft 120.

(d) Because the spring member 130 is housed between the outer shaft 110 and the inner shaft 120, it is possible to house a portion of the outer shaft 110 (e.g., the second shaft 12) housing the spring member 130 into the hollow portion 111 of another outer shaft 110 (e.g., the first shaft 11) having a larger diameter in a nesting manner. Therefore, when the stick-like tool 100 is formed by nesting three or more cylindrical members 11 to 14, the fully contracted length can be made compact irrespective of lengths of the spring members 130 fixed to the respective outer shafts 110.

(e) At the fully extended end of the inner shaft 120 with respect to the outer shaft 110, the spring member 130 fixed to the outer shaft 110 butts against and engages with the stopper portion 124 provided to the inner shaft 120 in the axial direction of the inner shaft 120. Therefore, in an extending operation for pulling the inner shaft 120 out of the outer shaft 110, it is possible to obtain the fully extended length without any concern that the inner shaft 120 comes off the outer shaft 110.

In the contracting operation for pushing the inner shaft 120 into the outer shaft 110, the outer face bulging portion 121A of the outer face bulging thick portion 121 at the tip end of the inner shaft 120 comes in contact with the end face of the opening 111A of the outer shaft 110 to thereby stop the pushed-in end.

(f) The working point portion 134 for resiliently coming in sliding contact with the outer face of the inner shaft 120 is provided at the middle portion of a long spring function portion made up of the folded portion 132 and the fulcrum portion 133 of the spring member 130 fixed to the outer shaft 110. Therefore, a deformation amount of the spring function portion due to resilient displacement of the working point portion 134 in pressure contact with the outer face of the inner shaft 120 is small and the spring member 130 is not deformed plastically and excellent in durability and reliability.

(g) At the opposite end portions of the spring member 130 fixed to the outer shaft 110, the folded rounded portion (R1) of the folded portion 132 and the bent rounded portion (R2) of the fulcrum portion 133 are provided. Both the rounded portions (R1 and R2) are hard and not deformed by a radial force applied between the outer shaft 110 and the inner shaft 120 due to the bending force or the like applied to the stick-like tool 100. Therefore, the clearance between the outer shaft 110 and the inner shaft 120 is maintained to be constant by both the above-described rounded portions (R1 and R2) and expansion and contraction reliability of the outer shaft 110 and the inner shaft 120 is excellent.

(h) At the fully extended end of the inner shaft 120 with respect to the outer shaft 110, the bent rounded portion (R3) of the working point portion 134 of the spring member 130 fixed to the outer shaft 110 is detachably locked to the fully extended lock portion 125 of the outer face of the inner shaft 120. It is possible to obtain a feeling of being restrained at the fully extended end in the extending operation for pulling the inner shaft 120 out of the outer shaft 110.

(i) The latch portion 132A provided to the folded portion 132 of the spring member 130 is fixedly locked to the fixing lock portion 113 provided to the outer shaft 110. The spring member 130 can be easily fixed to the outer shaft 110. In the assembly of the stick-like tool 100, the spring member 130 is provided along the outer face of the inner shaft 120 and the spring member 130 and the inner shaft 120 are inserted together into the hollow portion 111 of the outer shaft 110 from the opening 111A. When the latch of the folded portion 132 of the spring member 130 reaches the fixing lock portion 113 from the hollow portion 111 of the outer shaft 110, the latch portion 132A resiliently falls into the fixing lock portion 113 from the hollow portion 111 due to resilience of the folded portion 132 to thereby complete the assembly.

(j) The spring member 130 is provided on one side of the centers of the cross sections of the outer shaft 110 and the inner shaft 120 and the slide guide portion 101, where the V-shaped rib 112 extending in the axial direction of the inner face of the outer shaft 110 and the V-shaped groove 122 extending in the axial direction of the inner shaft 120 are engaged for sliding, is provided on the other side. The outer shaft 110 and the inner shaft 120 are guided in the axial direction by the slide guide portion 101 and extend and contract stably. By applying the lubricant of the suitable viscosity to the V-shaped rib 112 and the V-shaped groove 122 of the slide guide portion 101, wearing of the slide guide portion 101 can be suppressed, a proper degree of resistance to extension and contraction of the outer shaft 110 and the inner shaft 120 can be applied, and the expansion and contraction reliability can be enhanced.

Although the embodiment of the invention has been described in detail with reference to the drawings, a specific structure of the invention is not limited to the embodiment and changes in design may be included in the invention without departing from the gist of the invention. For example, the spring member of the invention is not limited to one made up of the leaf spring.

INDUSTRIAL APPLICABILITY

According to the invention, it is possible to easily change the angle of the main body with respect to the handle in the cleaning tool.

According to the invention, it is possible to make the outward appearance of the cleaning tool compact.

According to the invention, it is possible to easily change the angle of the main body with respect to the handle even if the handle of the cleaning tool is long.

The invention can provide the compact stick-like tool excellent in the outward appearance, continuously extendable, having no backlash, small in outside diameter, and small in the fully contracted length.

What is claimed is:

1. A cleaning tool, wherein a handle and a main body are pivoted on a pivot portion, recessed faces are provided at a plurality of positions on either the handle or the main body in a rotating direction about the pivot portion, an engagement member, provided on either the handle or the main body where the recessed faces are not provided, is biased toward the recessed faces so that the engagement member can resiliently move forward and backward to be repeatedly engaged in and detached from each of adjacent recessed faces as a result of rotation of the handle and the main body, a lock piece, provided on either the handle or the main body where the engagement member is provided, can be switched between a lock position and a lock release position, the lock piece positioned in the lock position butts against a stopper face of the engagement member to retain the engagement member in a position of engagement in the recessed face, and the lock piece positioned in the lock release position separates from the stopper face of the engagement member to allow the engagement member to resiliently move forward and backward.

2. The cleaning tool according to claim 1, wherein the lock piece is mounted for sliding in a guide hole provided in a direction intersecting a forward and backward movement path of the engagement member and includes an operating portion facing the outside from either the handle or the main body where the engagement member is provided and a lock portion for coming in contact with and separating from the stopper face of the engagement member, a spring provided between either the handle or the main body where the engagement member is provided and the lock piece biases the lock piece into the lock position and causes the lock portion of the lock piece positioned in the lock position to butt against the stopper face of the engagement member, and operation applied to the operating portion switches the lock piece to the lock release position and separates the lock portion of the lock piece positioned in the lock release position from the stopper face of the engagement member.

3. The cleaning tool according to claim 2, wherein the engagement member includes a protruding face to be engaged in and detached from the recessed face, a constricted portion on an opposite side to the protruding face in a direction of forward and backward movements of the engagement member, and the stopper face at a middle portion of the constricted portion in the direction of the forward and backward movements of the engagement member, the lock piece is in a shape of a frame, the constricted portion of the engagement member is disposed in the frame of the lock piece, the lock portion provided to a portion of the frame of the lock piece butts against the stopper face of the engagement member when the lock piece is positioned in the lock position, and the lock portion of the lock piece separates from the stopper face of the engagement member to allow the constricted portion of the engagement member to move forward and backward in the frame of the lock piece when the lock piece is positioned in the lock release position.

4. The cleaning tool according to claim 2 or 3, wherein the operating portion of the lock piece is disposed in an outer face recessed portion in either the handle or the main body where the engagement member is provided.

5. The cleaning tool according to claim 1, wherein the handle is extendable.

* * * * *